US007896727B2

(12) United States Patent
L'Helgoualc'h et al.

(10) Patent No.: US 7,896,727 B2
(45) Date of Patent: Mar. 1, 2011

(54) ROBOTIC MACHINING TOOL EMPLOYING AN ENDLESS MACHINING BELT

(75) Inventors: Carole L'Helgoualc'h, Versailles (FR); Paul Alexandre Pereira, Juvisy sur Orge (FR)

(73) Assignee: SNECMA, Paris (FR)

( * ) Notice: Subject to any disclaimer, the term of this patent is extended or adjusted under 35 U.S.C. 154(b) by 524 days.

(21) Appl. No.: 12/015,780

(22) Filed: Jan. 17, 2008

(65) Prior Publication Data

US 2009/0011691 A1 Jan. 8, 2009

(30) Foreign Application Priority Data

Jan. 18, 2007 (FR) ..... 07 00322

(51) Int. Cl.
*B24B 49/00* (2006.01)

(52) U.S. Cl. ..... 451/5; 451/11; 451/299; 451/310

(58) Field of Classification Search ..... 451/5, 451/8, 11, 299, 310
See application file for complete search history.

(56) References Cited

U.S. PATENT DOCUMENTS 4,178,723 A 12/1979 Fleckenstein et al.
4,392,333 A 7/1983 Welsch
4,654,949 A * 4/1987 Pryor ..... 29/407.04
5,297,484 A * 3/1994 Piserchia et al. ..... 105/1.5
5,772,496 A * 6/1998 Kurtz et al. ..... 451/296
5,960,717 A * 10/1999 Andre ..... 104/139

FOREIGN PATENT DOCUMENTS

DE 3525505 A1 3/1986
DE 3711278 A1 10/1988
JP 59205264 A * 11/1984

* cited by examiner

*Primary Examiner*—Maurina Rachuba
(74) *Attorney, Agent, or Firm*—Oblon, Spivak, McClelland, Maier & Neustadt, L.L.P.

(57) ABSTRACT

A robotic machining tool employing an endless machining belt is disclosed. The tool includes a front pulley and a rear pulley which guide the machining belt, a drive unit which turns the rear pulley, a spindle about which the front pulley is free to rotate, and two wheels which flank the front pulley and are mounted idly on the spindle of the front pulley. The two wheels have an outside diameter greater than that of the front pulley in order to roll over a surface to be machined and in order to define a machining distance between the machining belt guided around the front pulley and the surface to be machined.

7 Claims, 3 Drawing Sheets

ROBOTIC MACHINING TOOL EMPLOYING AN ENDLESS MACHINING BELT

This invention relates to a machine tool employing an endless machining belt designed to be mounted on a robot arm for the purpose of carrying out operations of polishing, grinding, deburring, shaving, brushing, etc., on any workpiece such as for example an exhaust casing of a turbine engine.

BACKGROUND OF THE INVENTION

The exhaust casing of a turbine engine is made up of several elements assembled together by weld beads which must be machined to produce a smooth profile along the weld bead and between the assembled elements.

DESCRIPTION OF THE PRIOR ART

The prior art includes a machine tool employing an endless abrasive belt guided around a driven pulley and a drive pulley whose axes of rotation are parallel, the driven pulley being mounted on the piston rod of a ram whose function is to separate the pulleys from each other and thus tension the abrasive belt between the pulleys.

Where the workpieces are relatively complex, this tool must be manipulated and guided manually by an operator, which makes the machining operations slow and expensive and relatively dangerous for the operator.

There are many other drawbacks to manual use of the machine tool by an operator. There is no way of defining a precise machining distance, that is to say a thickness of material remaining after machining, and therefore the smoothness of weld beads after machining depends entirely on the skill of the operator. Also, while the tool is being manipulated the abrasive belt may escape from the pulleys, whereupon the tool has to be stopped and the operator must intervene to put the abrasive belt back in position.

It is a particular object of the invention to provide a simple, effective and inexpensive solution to the problems of the prior art.

SUMMARY OF THE INVENTION

To this end, the invention provides a robotic machining tool, employing an endless machining belt, comprising two pulleys, one at the front and the other at the rear, to guide the machining belt, drive means for turning the rear pulley, while the front pulley rotates idly on a spindle carried by a support guided translationally on the body of the tool, and ram means for tensioning the belt between the two pulleys, in which tool the front pulley is flanked by two wheels rotating idly on the spindle of the front pulley, which two wheels have an outside diameter greater than that of the front pulley in order to roll over a surface to be machined and in order to define a machine distance between the machining belt guided around the front pulley and the surface to be machined, and are made of an electrically conducting material and are each connected by a conducting element to a terminal of an electrical energy source whose other terminal is intended to be connected to the workpiece, the tool further comprising, connected to means for controlling the position and path of the tool, means for detecting the passage of an electric current between each wheel and the workpiece.

The machining distance is defined as the distance between the working outer surface of the belt and the outer peripheral surfaces of the wheels.

When machining a weld bead on a surface of a workpiece, the machine tool is moved along the weld bead with the wheels situated on either side of the bead and in permanent contact with the surface of the work so that the thickness of the weld bead projecting from the work, after machining, is defined and constant all the way along the weld bead.

If the weld bead connects to non-aligned surfaces of the workpiece, each wheel is placed in contact with one surface of the workpiece, and the machining belt can machine the weld bead between the two misaligned surfaces.

In addition, the machining belt is prevented from escaping from the front pulley by the wheels mounted on either side of the pulley. This avoids sudden stopping of the machine operation and the intervention of an operator to put the belt back in position on the pulleys.

The wheels are preferably removably attached to the spindle of the front pulley. The machine distance can thus be changed by simply replacing the wheels mounted on the tool with other wheels having a different outside diameter.

In accordance with another feature of the invention, the wheels are made of an electrically conducting material and are each connected by a conducting element to one terminal of an electrical energy source whose other terminal is intended to be connected to the workpiece.

When a wheel is in contact with a surface to be machined of an electrically conducting part, and is rolling for example along a weld bead, an electric current passes between the wheel and this surface and is detected by appropriate means provided on the tool which transmit corresponding signals to control means of the tool. As soon as one of the wheels loses contact with the surface to be machined, the control means modify the position and path of the tool to ensure that both wheels are brought back into contact with the surface to be machined.

The wheels can be made of a wear-resistant metallic material and are electrically insulated from each other and from the rest of the tool.

The support of the front pulley is advantageously rotatable about an axis approximately parallel to the longitudinal axis of the ram. When the abovementioned means do not detect the passage of a current between one of the wheels and the surface to be machined, the support of the front pulley can be rotated about the longitudinal axis of the ram, until this wheel is in contact with the surface and the means once again detect the passage of a current between the wheel and the surface to be machined.

The tool comprises sensors for sensing the position of the piston of the ram, such as for example two sensors of the end-of-travel position of the ram piston (the fully retracted and fully extended positions) and a sensor for sensing an intermediate position in which a machining belt is stretched between the pulleys of the tool.

BRIEF DESCRIPTION OF THE DRAWINGS

The invention will be understood more clearly, and other details, features and advantages of the present invention will become apparent from the following description, given by way of non-restrictive example with reference to the appended drawings, in which.

DESCRIPTION OF THE PREFERRED EMBODIMENTS

Figure 1:
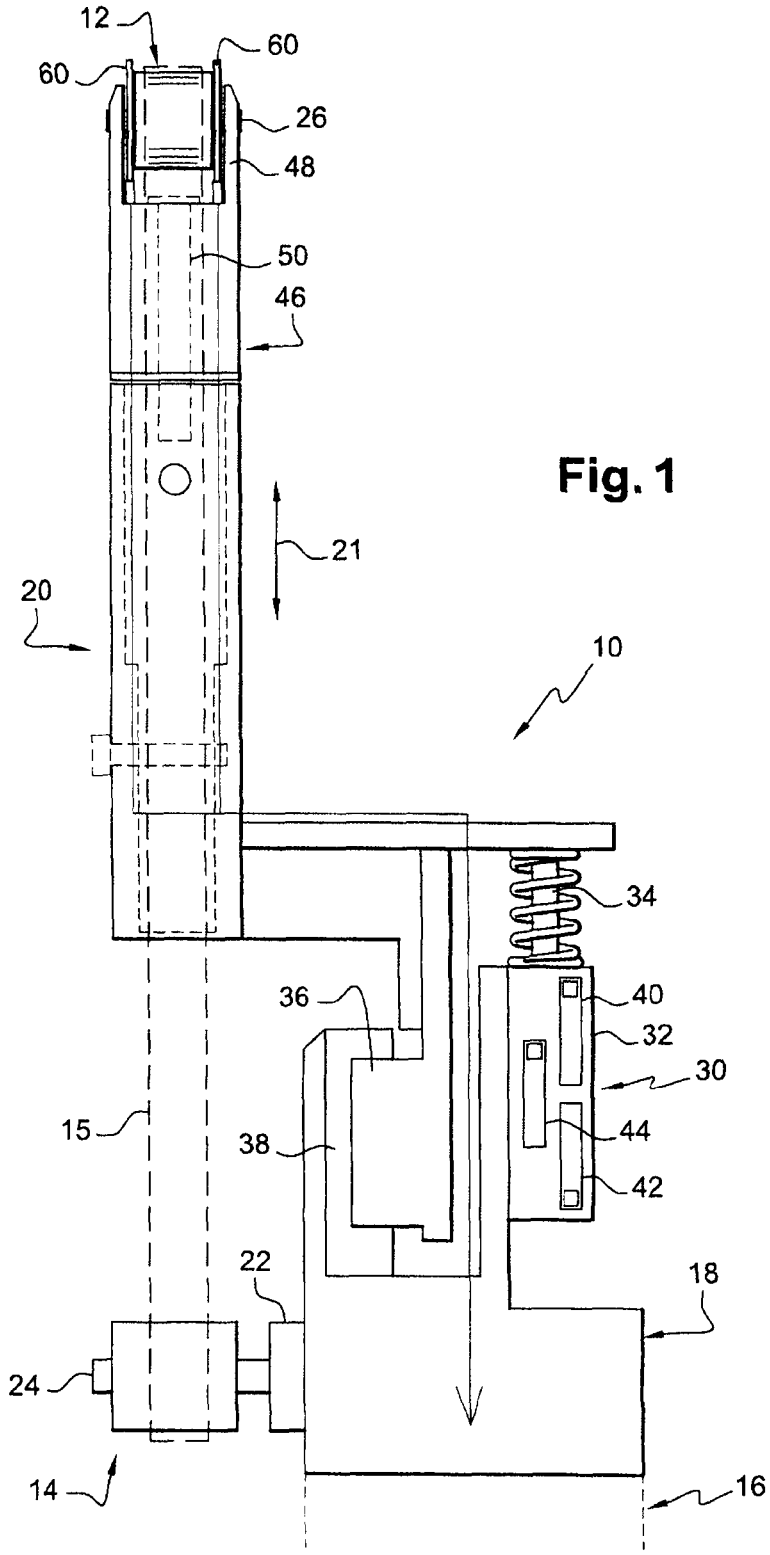
FIG. 1 is a schematic front view of the machine tool according to the invention.

Referring initially to FIG. 1, this is a schematic view of a machine tool 10 according to the invention comprising at its front end a driven pulley 12 and at its rear end a driving pulley 14, these pulleys 12, 14 having parallel axes of rotation and being capable of driving and guiding an endless machining belt 15 such as an abrasive belt. The tool 10 is designed to be carried by a robot arm 16 to carry out operations of polishing, grinding, deburring, shaving, brushing, etc., on any workpiece such as for example an exhaust casing of a turbine engine.

As will be described in greater detail later, the tool 10 is moved by the robot arm 16 backwards or forwards in such a way that the machining belt 15, driven and guided by the pulleys 12, 14, is applied by the front pulley 12 to a surface of a workpiece to machine this surface by abrasion.

Here, the tool 10 is elongated in shape and comprises at the rear a base 18 mounted on one end of the robot arm 16, and at the front a body 20 which is guided translationally on the base 18 along the longitudinal axis of the tool (double arrow 21).

The base 18 has drive means 22 for turning a spindle 24 on which the drive pulley 14 is mounted. The driven pulley 12 is mounted idly on a spindle 26 that is parallel to the spindle 24 of the driving pulley 14 and that is mounted at the front end of the body 20 of the tool.

The tool 10 also comprises a ram 30 whose cylinder 32 is mounted on the base 18 of the tool with a piston rod 34 connected to the rear end of the body 20 of the tool for the translational movement of the body 20. Carried at the rear end of the body 20 is a slider 36 engaged with a rail 38 mounted on the base 18 of the tool for the translational guidance of the tool body.

When the pulleys 12 and 14 are engaged in the ends of a machining belt 15, the piston rod 34 of the ram is extended until the belt 15 is stretched between the pulleys 12, 14.

The tool includes three sensors 40, 42 and 44 for detecting the position of the piston rod 34 of the ram. These are connected to a control unit of the tool 10. The sensors 40 and 42 transmit signals to the control unit when the piston rod 34 of the ram is in a fully extended position and in a fully retracted position, respectively. The sensor 44 emits a signal when the piston rod of the ram is partially extended and the pulleys 12, 14 of the tool are far enough apart to stretch a belt between the pulleys of the tool, as is the case in FIG. 1.

The body 20 of the tool is connected at its front end to a U-shaped fork 46 which has two arms 48 parallel and a certain distance apart and containing bearings for the ends of the spindle 26 on which the front pulley 12 is to rotate. This fork 46 is mounted so that it can rotate on the front end of the body 20 about an axis approximately parallel to the longitudinal axis of the tool. In the example shown, the fork 46 is supported by a spindle 50 located centrally in and guided rotationally by a corresponding bore in the body 20 of the tool and turned by drive means carried by the tool.

The tool 10 also comprises two identical wheels 60 mounted so as to turn freely on the spindle 26 of the front pulley 12, on either side of this pulley 12. The wheels 60 are located between the pulley 12 and the arms 48 of the fork 46, parallel to the arms 48 of the fork, and are separated from these arms and from the front pulley.

The wheels 60 have an outside diameter greater than that of the front pulley 12 and are designed to roll over a surface to be machined as the tool travels over this surface. Also, when a machining belt 15 is mounted on the tool, it is prevented from slipping off the pulley 12 by the wheels 60 mounted on each side of the pulley 12.

Figure 2:
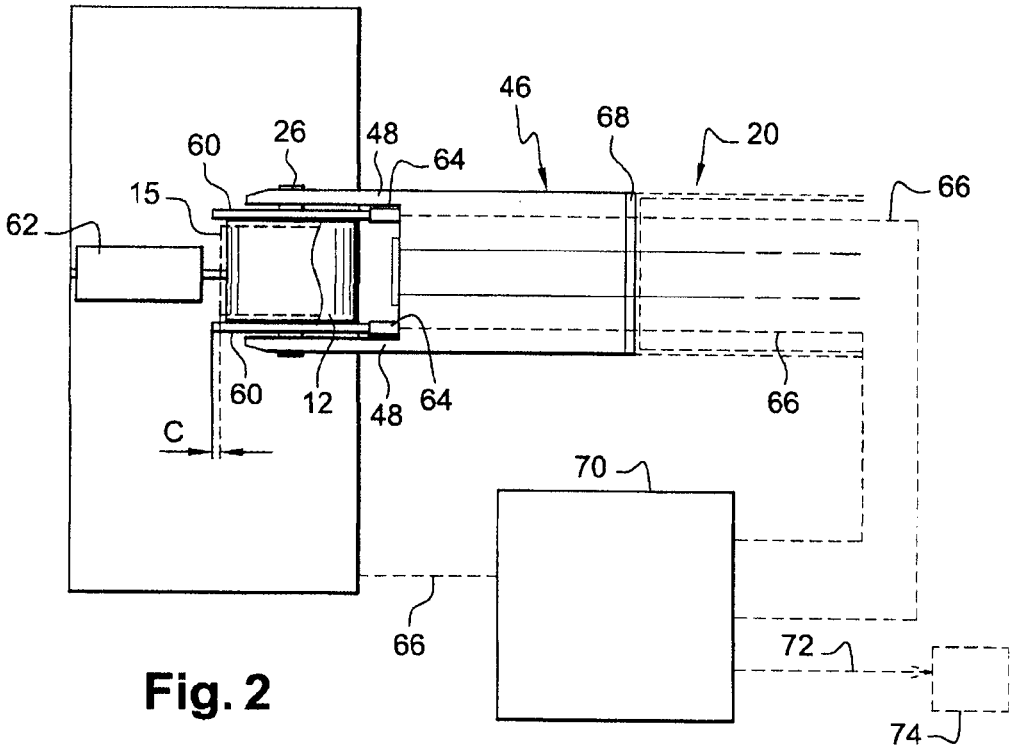
FIG. 2 is a partial schematic front view of the machine tool of FIG. 1, on a large scale.
Figure 3:
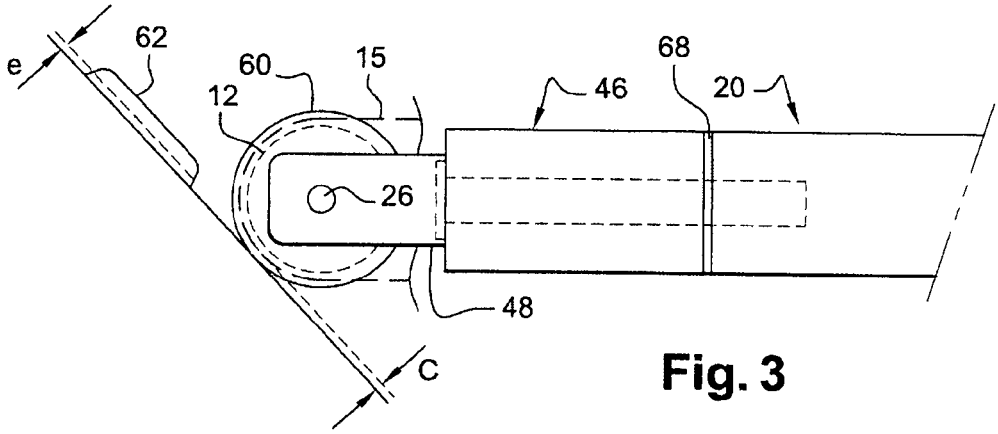
FIG. 3 is a partial schematic side view of the machine tool of FIG. 1, on a larger scale.

The distance, measured on a radius from the axis 26 of rotation of the pulley 12, between the outer working surface of the belt 15 and the outer peripheral surfaces of the wheels 60, defines a machining distance C, corresponding to a thickness of material projecting from a surface after this surface has been machined (FIGS. 2 and 3). Thus, when the wheels 60 are held permanently in contact with a workpiece comprising a weld bead 62 that must be machined off, this weld bead will have, after machining, a thickness e theoretically equal to this machining distance. The weld bead 62 to be machined is narrower than the belt 15 and than the pulley 12 so that the wheels 60 can roll along on either side of the bead without coming into contact with it.

The machining distance C can be modified by replacing the wheels 60 mounted on the tool with other wheels having a different outside diameter. The wheels are therefore mounted removably on the tool 10.

To ensure that the wheels 60 are always in contact with the workpiece, the tool includes means 70 for generating and detecting an electric current between the wheels 60 and the workpiece, and these means are connected to the control unit 74 controlling the tool 10 and the robot arm.

The wheels 60 are made of an electrically conducting material and are connected by conducting elements 64 to a terminal of a source of electrical energy whose other terminal is connected to the workpiece, which is itself made of electrically conducting material (FIG. 2). The source of electrical energy is connected to the conducting elements 64 and to the workpiece by appropriate means such as electric wires 66.

The conducting elements 64 are fixed to the fork 46 and are each pressed against the outer peripheral surface of a wheel 60, preferably under spring pressure. The wheels 60 are in rubbing contact with the conducting elements 64 and are preferably made of a wear-resistant metallic material such as a tungsten-based composite material for example. The wheels 60 are insulated electrically from each other and from the other components of the tool 10. The conducting elements 64 are also insulated electrically from each other and from the rest of the tool 10. An electrical insulator 68 is also mounted between the fork 56 and the body 20 of the tool.

The means 70 detect the passage of an electric current between each of the wheels 60 and the workpiece and transmit corresponding signals 72 to the control unit 74 controlling the tool 10 and the robot arm 16 to modify the position and path of the tool as a consequence.

Figure 4:
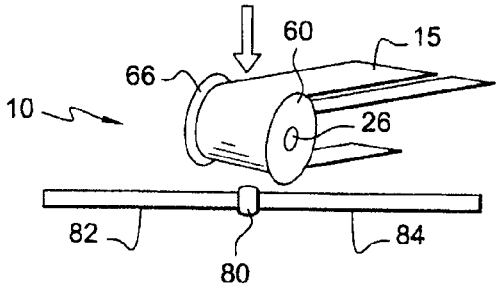
FIGS. 4-6 are highly schematic partial perspective views of the front part of the machine tool according to the invention, and show steps in a process of machining off a weld bead connecting two aligned walls of a workpiece.
Figure 5:
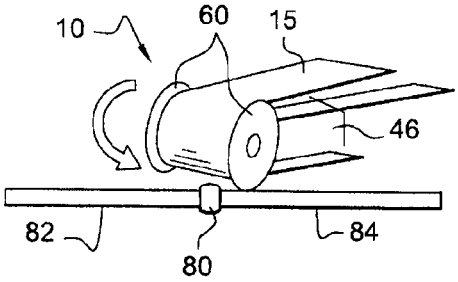
Figure 6:
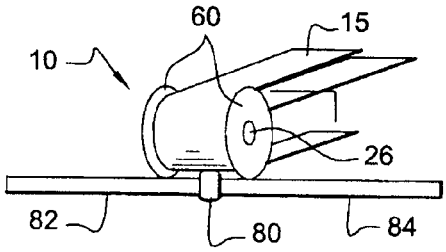

FIGS. 4-6 show steps in a process of machining a weld bead 80 between two aligned walls 82, 84 of a workpiece.

The front pulley 12 of the tool is advanced toward the weld bead 80 (FIG. 4) until at least one of the wheels 60 of the tool makes contact with one wall 84 of the workpiece. This contact sends a current between the wheel 60 and the workpiece which is detected by the means 70.

If only one wheel 60 is in contact with a wall 84 of the workpiece, as in FIG. 5, the unit 74 tells the fork 46 to pivot until the other wheel 60 also makes contact with the other wall 82 of the workpiece, this contact causing a current to pass between the wheel and the wall 82 which is detected by the means 70 (FIG. 6). The tool is now in position to machine the weld bead 80, with the wheels one on either side of the weld bead 80 and the axis 26 of rotation of the front pulley 12 approximately parallel to the walls 82, 84 of the workpiece. The tool 10 is now moved backwards or forwards along the weld bead so that the belt 15 is applied to the weld bead 80 by the pulley 12 and grinds off the excess bead material, that is it grinds off the thickness greater than the predetermined machining difference. The tool 10 may also possess means for aligning the path of the tool 10 with the weld bead 80.

Figure 7:
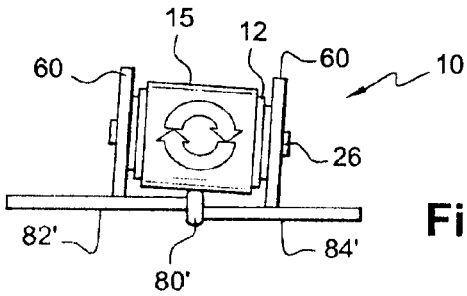
FIG. 7 is a partial schematic view of the machine tool according to the invention, seen from the front, and shows a step in a process of machining off a weld bead connecting two misaligned walls of a workpiece.

In the example shown in FIG. 7, the tool 10 is used to grind down a weld bead 80' between two walls 82', 84' that are misaligned relative to each other, in the sense that they form a step or shoulder. The unit 74 tells the fork 46 to pivot so that each wheel 60 is in contact with a wall 82', 84' of the work. In this case the axis 26 of rotation of the front pulley 12 is inclined relative to each of the walls 82', 84'.

In the abovementioned examples, the fork 46 may be free to pivot about the longitudinal axis of the tool through a small angle, without the control unit 74 having to intervene or even requiring a change in the position and path of the tool. This allows the tool to adjust to any height differences between the walls of a workpiece and/or any imperfections in these walls.

The invention claimed is:

1. A robotic machining tool, employing an endless machining belt, comprising:

a front pulley and a rear pulley which guide the machining belt a drive unit which turns the rear pulley;

a spindle carried by a support guided translationally on a body of the tool, the front pulley rotating idly on the spindle;

a ram device which tensions the belt between the two pulleys;

two wheels which flank the front pulley, the wheels rotating idly on the spindle of the front pulley and each wheel having an outside diameter greater than an outside diameter of the front pulley in order to roll over a surface to be machined and in order to define a machine distance between the machining belt guided around the front pulley and the surface to be machined, the wheels being made of an electrically conducting material, each wheel being connected by a conducting element to an electrical energy source at a first terminal, a second terminal of the electrical energy source is connected to the workpiece;

a control unit which controls a position and path of the tool; and a detecting unit which detects passage of an electric current between each wheel and the workpiece.

2. The tool as claimed in claim 1, wherein a support of the front pulley is rotatable about an axis approximately parallel to a longitudinal axis of the ram device.

3. The tool as claimed in claim 1, comprising three sensors which sense a position of a piston of the ram device.

4. The tool as claimed in claim 1, wherein the tool is mounted on a robot arm.

5. The tool as claimed in claim 1, wherein the wheels are removably attached to the spindle of the front pulley.

6. The tool as claimed in claim 1, wherein the wheels are made of a wear-resistant metallic material.

7. The tool as claimed in claim 1, wherein the wheels are electrically insulated from each other and from the rest of the tool.

* * * * *

UNITED STATES PATENT AND TRADEMARK OFFICE

CERTIFICATE OF CORRECTION

PATENT NO. : 7,896,727 B2
APPLICATION NO. : 12/015780
DATED : March 1, 2011
INVENTOR(S) : Carole L'Helgoualc'h et al.

It is certified that error appears in the above-identified patent and that said Letters Patent is hereby corrected as shown below:

Column 5, line 4, after "belt" insert --;--.

Signed and Sealed this
Third Day of April, 2012

David J. Kappos

David J. Kappos
*Director of the United States Patent and Trademark Office*